US012232560B2

(12) United States Patent
Fusco et al.

(10) Patent No.: US 12,232,560 B2
(45) **Date of Patent: *Feb. 25, 2025**

(54) FOOTWEAR ARTICLE FOR WALKING

(71) Applicant: Fuerst Group, Inc., Menlo Park, CA (US)

(72) Inventors: Ciro Fusco, Portland, OR (US); Dewayne Dale, Portland, OR (US); Michael Leoniak, Milwaukie, OR (US); Rory Fuerst, Atherton, CA (US)

(73) Assignee: FUERST GROUP, INC., Menlo Park, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 18/163,229

(22) Filed: Feb. 1, 2023

(65) Prior Publication Data

US 2023/0180886 A1 Jun. 15, 2023

Related U.S. Application Data

(62) Division of application No. 16/784,165, filed on Feb. 6, 2020, now Pat. No. 11,633,009.

(60) Provisional application No. 62/802,123, filed on Feb. 6, 2019.

(51) Int. Cl.
*A43B 13/14* (2006.01)

(52) U.S. Cl.
CPC ..... *A43B 13/141* (2013.01)

(58) Field of Classification Search
CPC ..... A43B 13/141; A43B 13/02; A43B 13/026; A43B 13/183; A43B 13/145
See application file for complete search history.

(56) References Cited

U.S. PATENT DOCUMENTS

| | | | |
|---|---|---|---|
| 2,810,213 | A | 10/1957 | Jonas |
| 4,098,010 | A | 7/1978 | Rothmayer |
| 4,155,180 | A | 5/1979 | Phillips |
| 4,206,558 | A | 6/1980 | Bivona |
| 4,247,996 | A | 2/1981 | Grapin et al. |
| 4,372,059 | A | 2/1983 | Ambrose |
| 5,135,450 | A | 8/1992 | Smith, IV |

(Continued)

FOREIGN PATENT DOCUMENTS

| | | | |
|---|---|---|---|
| KR | 100798868 | B1 | 2/2008 |
| KR | 20090081710 | A | 7/2009 |

OTHER PUBLICATIONS

"Pébiott: primitive foot comfort," Pébiott Website, Available Online at http://pebiott.com/, Available as Early as Oct. 23, 2017, 20 pages.

(Continued)

*Primary Examiner* — Bao-Thieu L Nguyen
(74) *Attorney, Agent, or Firm* — McCoy Russell LLP

(57) ABSTRACT

Footwear articles for walking are provided. In one example, a footwear article may include a midsole with a lower surface of constant curvature extending from a heel of the midsole to a toe of the midsole, wherein the lower surface maintains the constant curvature throughout a stance phase of a walking gait. In this way, a smooth step-to-step transition and a smaller range of oscillation of the center of mass of the wearer is achieved, and energy expenditure during walking is reduced. In turn, a wearer of the footwear article may smoothly walk for extended periods of time with reduced fatigue.

7 Claims, 12 Drawing Sheets

(56) References Cited

U.S. PATENT DOCUMENTS

| | | | | |
|---|---|---|---|---|
| 6,421,935 | B1 | 7/2002 | Bartlett | |
| 6,782,639 | B1 * | 8/2004 | Muller | A43B 13/145 36/117.4 |
| D650,979 | S | 12/2011 | Marku | |
| 8,529,411 | B2 | 9/2013 | DiGiovanni | |
| 9,655,401 | B2 | 5/2017 | Colpack | |
| 9,770,066 | B2 | 9/2017 | Grelle et al. | |
| 9,878,229 | B2 | 1/2018 | Lefebvre et al. | |
| 10,292,452 | B2 | 5/2019 | Hansen et al. | |
| 11,633,009 | B2 * | 4/2023 | Fusco | A43B 13/02 36/102 |
| 2003/0079373 | A1 | 5/2003 | Geer et al. | |
| 2007/0068043 | A1 | 3/2007 | Clark et al. | |
| 2008/0289215 | A1 | 11/2008 | Park | |
| 2009/0183393 | A1 | 7/2009 | Lee | |
| 2009/0193687 | A1 | 8/2009 | Kim | |
| 2010/0146819 | A1 | 6/2010 | Teteriatnikov et al. | |
| 2010/0146825 | A1 | 6/2010 | Teteriatnikov et al. | |
| 2010/0263228 | A1 | 10/2010 | Kang | |
| 2010/0263234 | A1 | 10/2010 | Teteriatnikov et al. | |
| 2010/0275471 | A1 | 11/2010 | Teteriatnikov et al. | |
| 2010/0299969 | A1 | 12/2010 | Paez | |
| 2010/0307028 | A1 * | 12/2010 | Teteriatnikov | A43B 13/145 36/108 |
| 2011/0067269 | A1 | 3/2011 | Luo | |
| 2011/0072690 | A1 | 3/2011 | Teteriatnikov et al. | |
| 2011/0185593 | A1 | 8/2011 | Ramos | |
| 2012/0167414 | A1 | 7/2012 | Shrairman | |
| 2014/0047740 | A1 | 2/2014 | Tucker et al. | |
| 2014/0230281 | A1 | 8/2014 | Engell | |
| 2014/0276317 | A1 | 9/2014 | Batterson et al. | |
| 2015/0033582 | A1 | 2/2015 | Colpack | |
| 2015/0164179 | A1 | 6/2015 | Walborn et al. | |
| 2015/0289594 | A1 | 10/2015 | Rushbrook et al. | |
| 2016/0295955 | A1 * | 10/2016 | Wardlaw | A43B 5/06 |
| 2016/0345668 | A1 | 12/2016 | Dyer et al. | |
| 2016/0345675 | A1 | 12/2016 | Bruce et al. | |
| 2017/0224048 | A1 | 8/2017 | Nagano et al. | |
| 2017/0258175 | A1 | 9/2017 | Li | |
| 2018/0184756 | A1 | 7/2018 | Bartel et al. | |
| 2018/0213886 | A1 | 8/2018 | Connell et al. | |
| 2018/0255868 | A1 | 9/2018 | Cole | |
| 2021/0085025 | A1 | 3/2021 | Geis et al. | |

OTHER PUBLICATIONS

ISA Korean Intellectual Property Office, International Search Report and Written Opinion Issued in Application No. PCT/US2020/016884, May 25, 2020, WIPO, 12 pages.

* cited by examiner

FOOTWEAR ARTICLE FOR WALKING

CROSS REFERENCE TO RELATED APPLICATIONS

The present application is a divisional of U.S. patent application Ser. No. 16/784,165, entitled FOOTWEAR ARTICLE FOR WALKING, and filed Feb. 6, 2020, which claims priority to U.S. Provisional Application No. 62/802,123, entitled FOOTWEAR ARTICLE FOR WALKING, and filed on Feb. 6, 2019. The entire contents of each of the above-listed applications are hereby incorporated by reference for all purposes.

BACKGROUND/SUMMARY

Walking is one of the primary gaits of locomotion for humans. Walking is defined or modeled by an "inverted pendulum" gait in which the body vaults over the stiff limb with each step, such that the center of mass oscillates vertically from step to step. Walking is typically slower than other gaits, such as running, and may be further distinguished from gaits such as running or jogging by considering that only one foot leaves contact with the ground at a time.

Footwear articles are thus designed differently for different gaits, as the mechanics of the body are different. For example, footwear articles designed for running are typically constructed to provide additional cushioning in the heel which is the point of impact, to provide shock absorption. Meanwhile, footwear articles designed specifically for walking are typically constructed to be more flexible through the ball of the foot to allow a greater range of motion through the roll of the forefoot.

The inventors have recognized several drawbacks with this traditional approach. For example, the range of oscillation of the center of mass may be rather large, such that a walking motion may be considered "bouncy" with excessive energy expenditure. Further, the flexing of the ankle joint and the metatarsal joint adjacent to the ball of the foot during the stance phase (i.e., from heel strike to toe off) results in substantial energy loss. As a result, even if some footwear articles designed for walking may be comfortable due to properly positioned cushioning and flexibility, a user of such footwear may become fatigued after walking for an extended period of time.

To at least partially address the above issues, the inventors herein have taken alternative approaches to footwear construction. In one example, a footwear article may include a midsole with a lower surface of constant curvature extending from a heel of the midsole to a toe of the midsole, wherein the lower surface maintains the constant curvature throughout a stance phase of a walking gait, such that the curved midsole helps to achieve a smooth step-to-step transition and a smaller range of oscillation of the center of mass. The footwear article further includes a moderation plate which is inflexible and inhibits the range of flexion at the metatarsal joint, while also imparting a rigidity to the midsole which further promotes smooth rolling of the foot while walking. In this way, the loss of energy at the metatarsal joint is minimized and overall energy expenditure during walking is reduced. In turn, a wearer of the footwear article may smoothly walk for extended periods of time with reduced fatigue.

BRIEF DESCRIPTION OF THE FIGURES

FIGS. 1-19 are shown to scale. However, other relative dimensions may be used if desired.

DETAILED DESCRIPTION

Figure 1A:
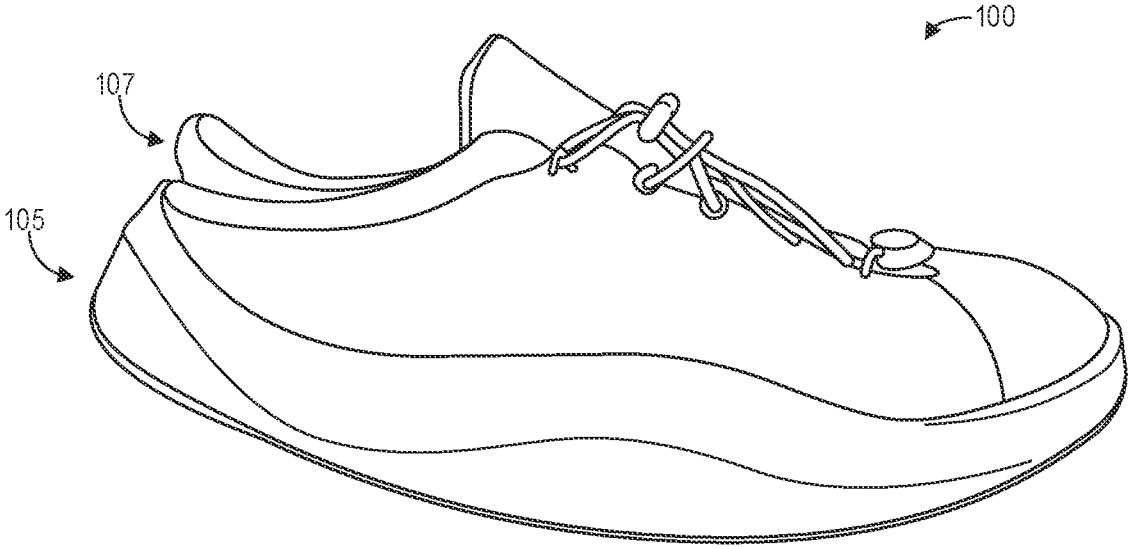
FIG. 1A shows a side lateral view of a footwear article with a curved midsole.
Figure 3:
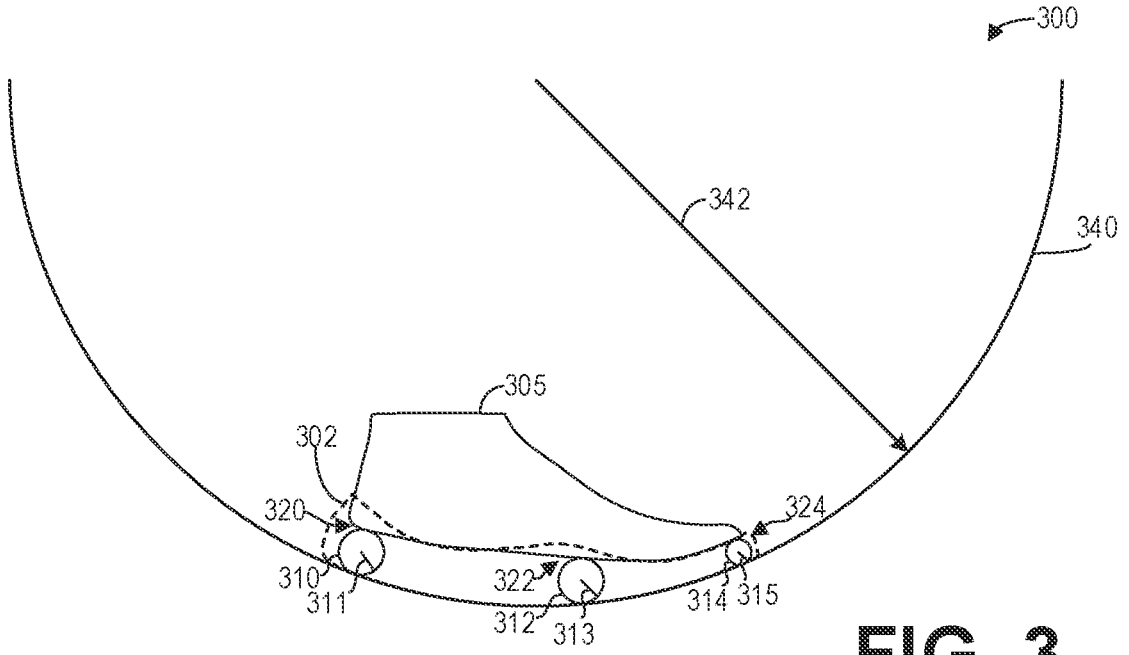
FIG. 3 shows a diagram illustrating constant curvature for a midsole.
Figure 4:
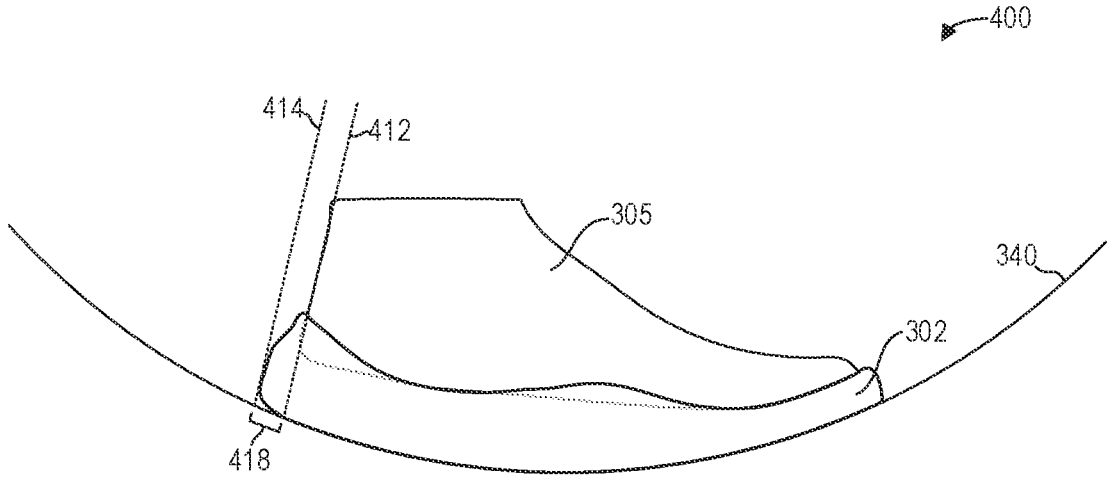
FIG. 4 shows a diagram illustrating an example rear extension for a curved midsole.
Figure 5:
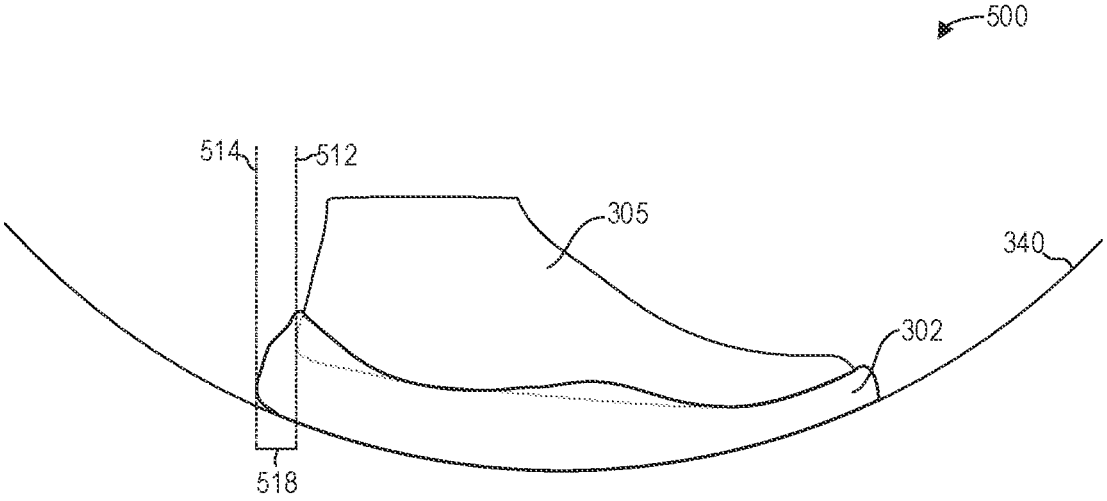
FIG. 5 shows a diagram illustrating another example rear extension for a curved midsole.
Figure 6:
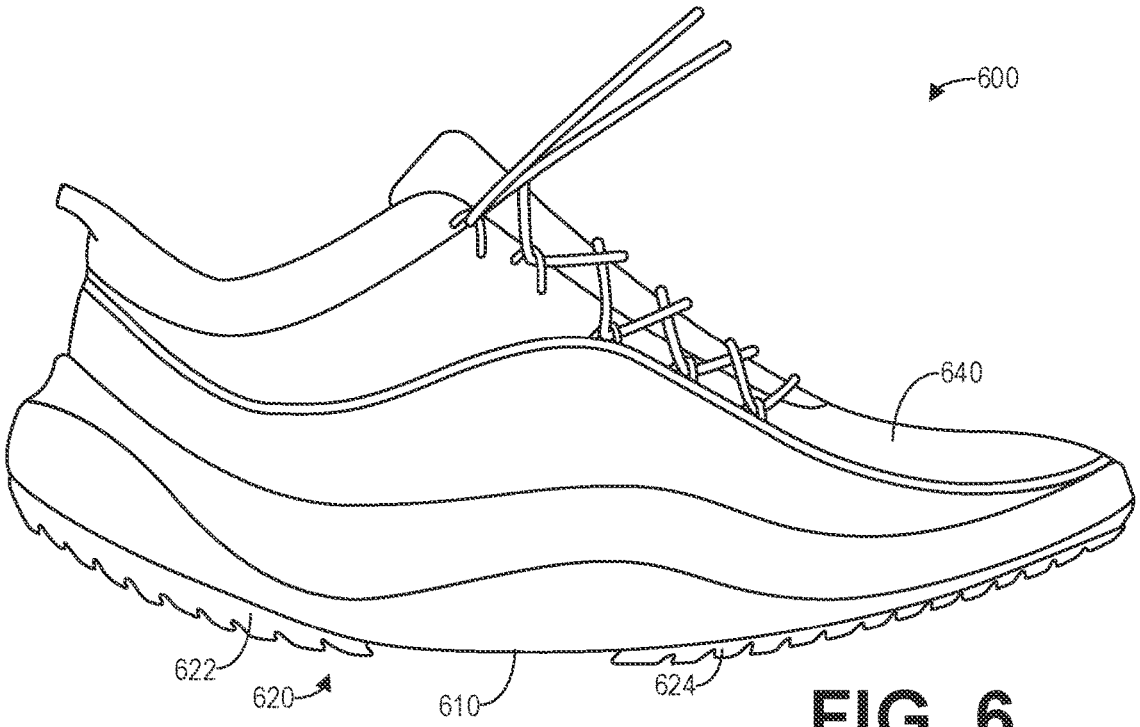
FIG. 6 shows a footwear article with a curved midsole and an example two-part upper.
Figure 7:
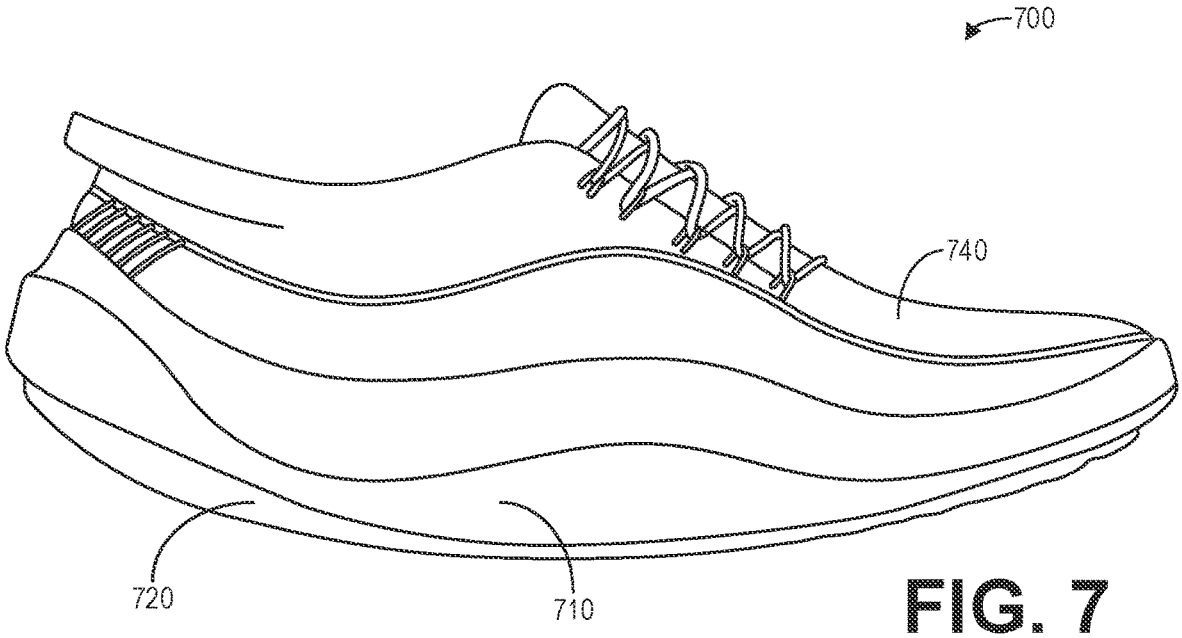
FIG. 7 shows a footwear article with a curved midsole and another example two-part upper.
Figure 8:
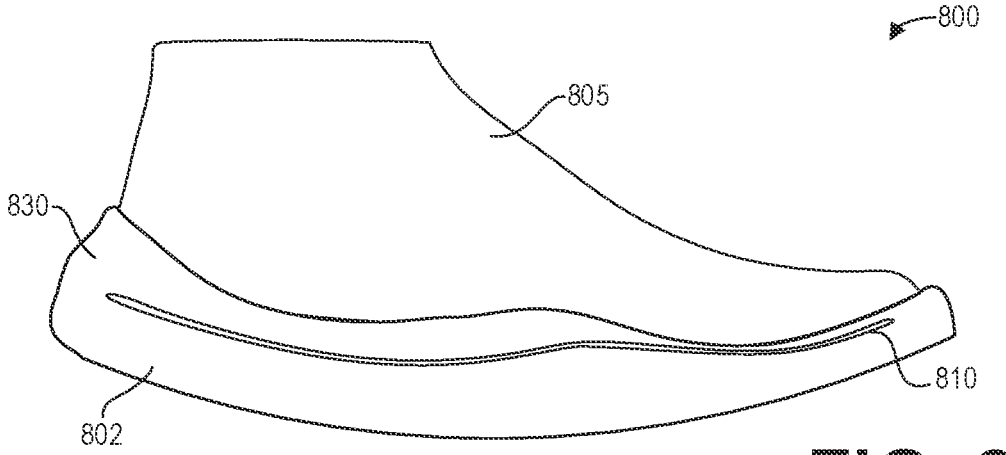
FIG. 8 shows a diagram illustrating a side view of a footwear article with a moderation plate in a curved midsole.
Figure 9:
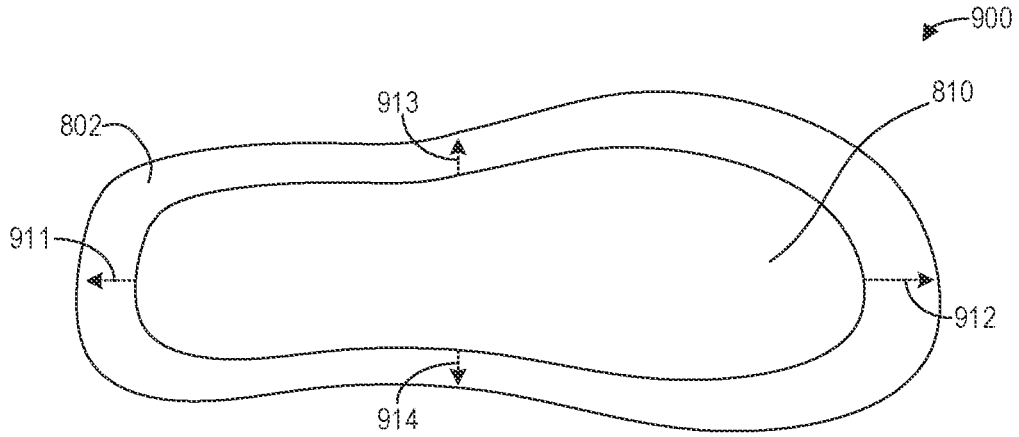
FIG. 9 shows a diagram illustrating a top view of a moderation plate in a curved midsole.
Figure 10:
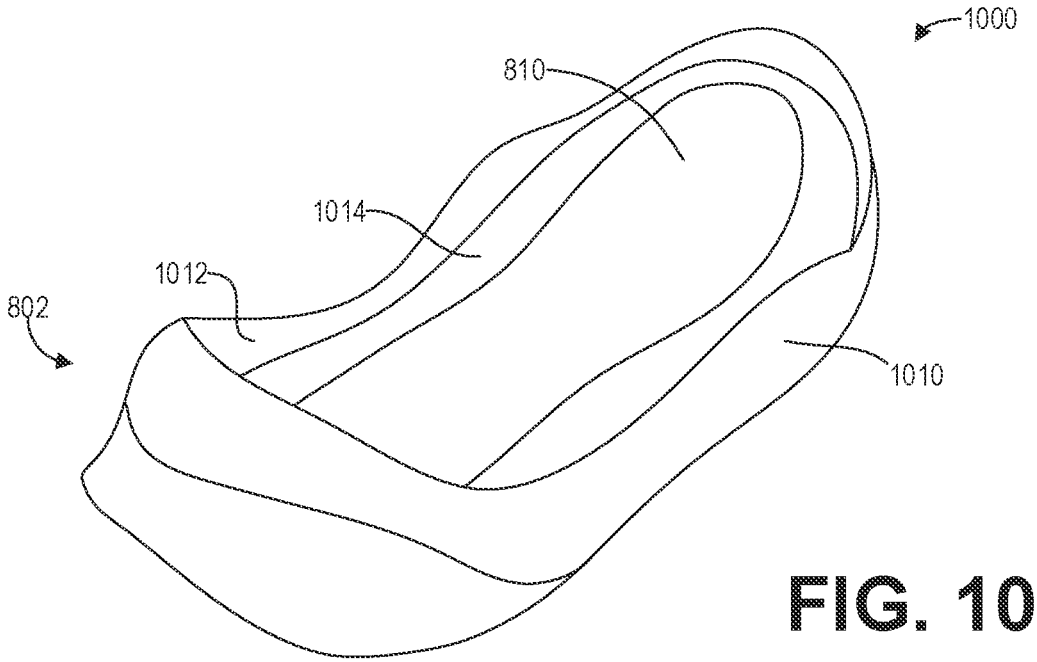
FIG. 10 shows a diagram illustrating a perspective view of a moderation plate in a curved midsole.
Figure 17:
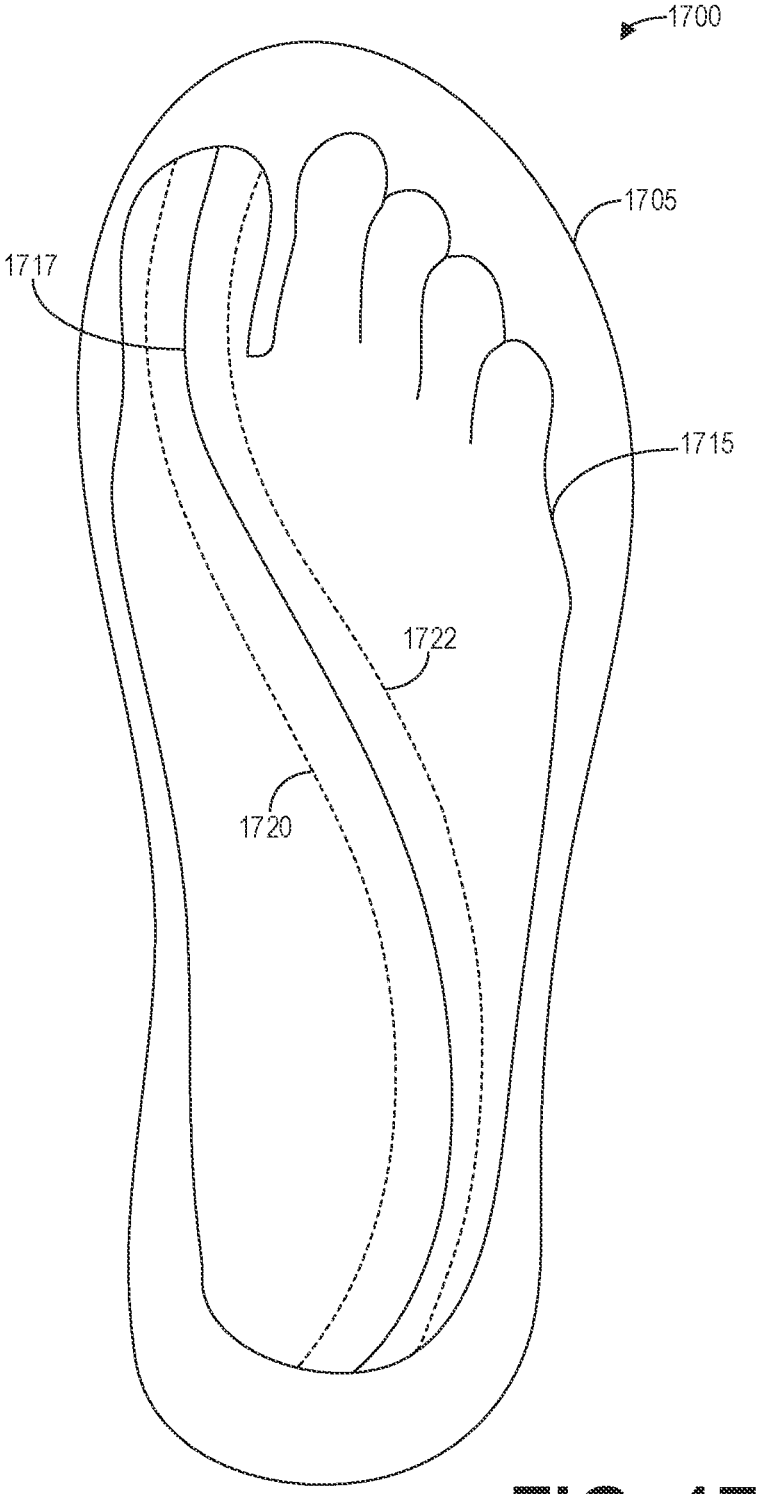
FIG. 17 shows a diagram illustrating a center-of-pressure line relative to a midsole for selective placement of traction elements.
Figure 18:
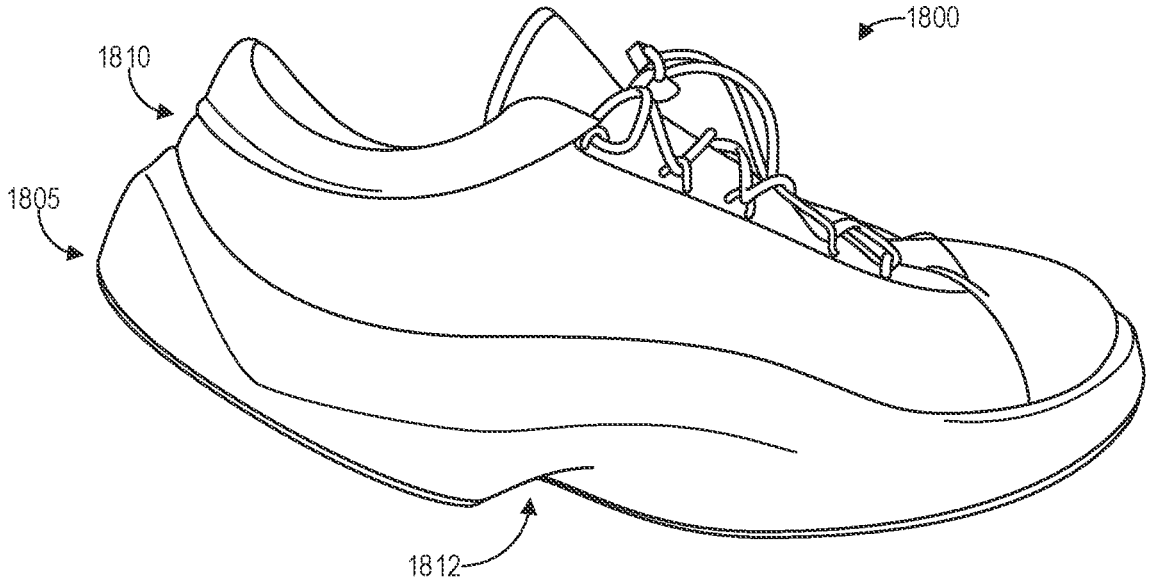
FIG. 18 shows a side lateral view of a footwear article with a curved midsole with minimized materials according to a center-of-pressure line.
Figure 19:
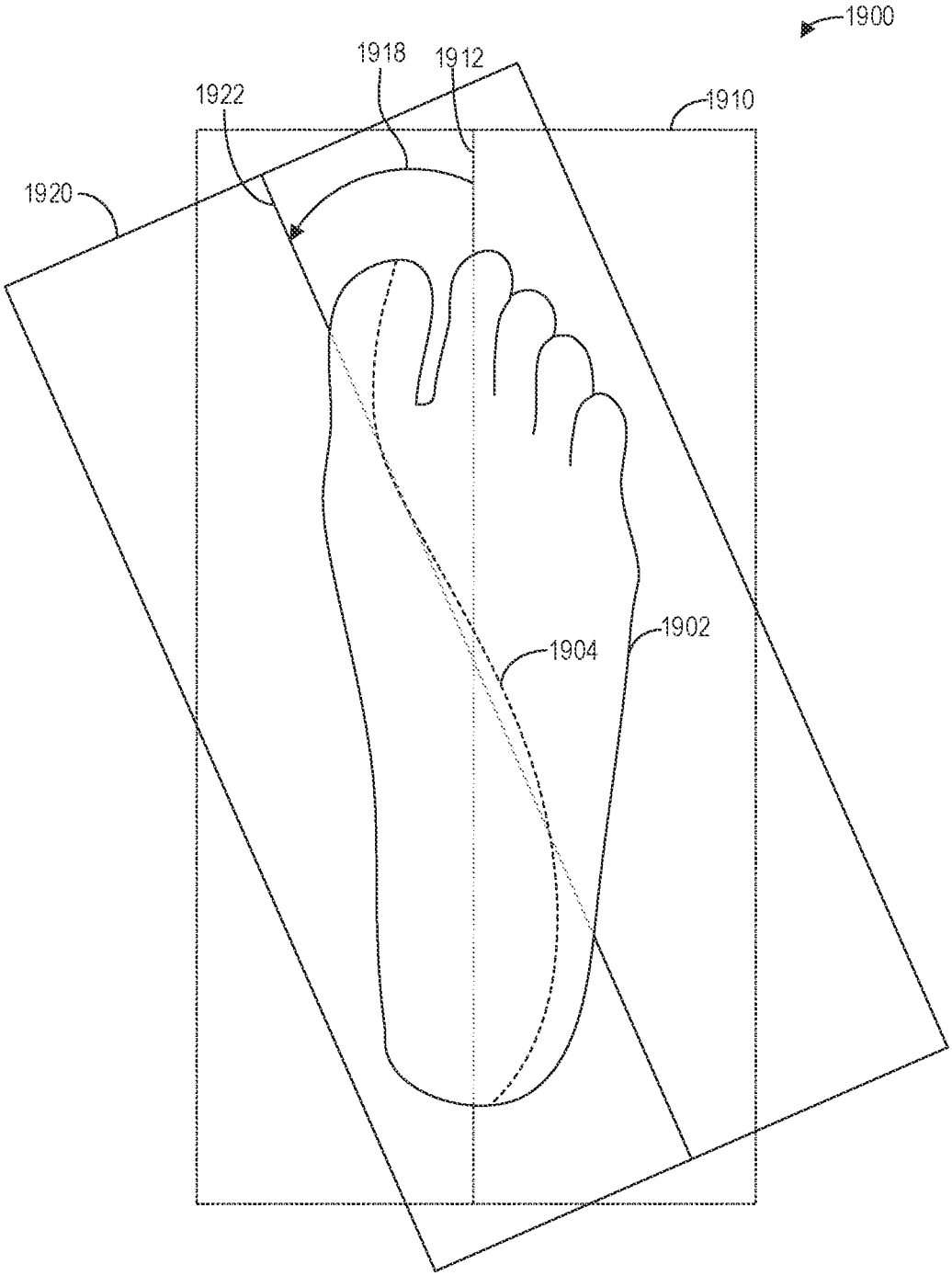
FIG. 19 shows a diagram illustrating a rotation of curvature of a curved midsole relative to the center-of-pressure line.

Systems and methods for a footwear article are described herein. A footwear article, such as the footwear articles shown in FIGS. 1A and 1B, include curved midsoles with a constant curvature along the sagittal plane for reducing energy expenditure and improving efficiency during walking. Example soles including curved midsoles are depicted in FIGS. 2A-2D. In particular, the curvature of the midsole along the longitudinal axis (i.e., heel to toe) relative to the position of a foot within the footwear article, as depicted in FIG. 3, enables a smooth step-to-step transition during walking and a smaller range of oscillation of the center of mass. As depicted in FIGS. 4 and 5, the heel of the midsole may be elongated as well as curved to further reduce the range of oscillation of the center of mass without affecting the gait. The curved midsole profile may be implemented with different styles of upper as well as different traction elements for an outsole, as depicted in FIGS. 6 and 7. A moderation plate may be positioned within a cavity of the curved midsole, as depicted in FIGS. 8-10, to be as close as possible to a foot positioned with the footwear article. As depicted in FIGS. 11-16, the geometric profile of the moderation plate may be selected to minimize the loss of energy at the metatarsal joint by inhibiting the range of flexion of the metatarsal joint, as well as promote smooth rolling of the foot while walking. Traction elements may be selectively positioned on an outsole of the footwear article in necessary and sufficient regions with consideration of a center-of-pressure line exhibited during normal walking, as depicted in FIG. 17. In some examples, a minimal possible weight of the footwear article may be achieved by removing unnecessary material, such as from the midsole of the footwear article as depicted in FIG. 18, according to the center-of-pressure line. The midsole may be curved along the center-of-pressure line (e.g., the heel-to-toe strike direction) rather than the longitudinal axis of the foot, as depicted in FIG. 19, to further smooth the step-to-step transition during walking. The advantageous distribution of forces for a curved midsole provides better energy performance in comparison to footwear articles without midsoles of constant curvature. Thus the footwear articles provided herein reduce the forces felt by the walker, preserves the energy that would be lost with the goal of re-using it later in the gait cycle, and reduces the overall loss of energy, thereby reducing the overall energy expenditure.

As discussed further herein, a footwear article with a sole of constant heel-to-toe curvature provides a number of advantages, including dispersing the load on impact over a larger, more non-uniform area. When the weight of the person wearing the footwear article touches down, if the force is concentrated on one flat area, the force will be greater as it will be applied to the single one-dimensional surface, while the curvature of a curved sole as provided herein disperses the load. Further, once the initial impact has occurred and load is applied, the constant curve of the sole promotes a fluid and consistent transition from heel impact all the way through to toe-off. As the curved sole holds its shape while correlated to the wearer's biomechanics properly, the curved sole helps smooth out the transition from heel to toe. Further, the curvature provides energy transfer through the transition. Furthermore, as discussed herein, the constant curve is extended past the point of the actual heel of the wearer, which effectively lengthens the foot thereby allowing for a shorter stride or increased cadence which in turn promotes efficiency and reduces the overall time spent on either foot, decreasing the load to each side of the body during a step. As another advantage of the extended heel and curved sole, the footwear article described herein provides a slight amount of cushion before the transition to the stiffer plate before the full weight of the body has loaded the plate.

FIG. 1 shows a side lateral view of a footwear article 100 with a curved midsole 105 according to an embodiment. In particular, the midsole 105 of the footwear article 100 is curved along the longitudinal axis to achieve a smooth step-to-step transition and a smaller range of oscillation in the center of mass of a person wearing the footwear article 100 during walking. The curved midsole 105 is coupled to an upper 107 which conforms to a foot (not shown) inserted into the footwear article 100. To that end, the upper 107 may comprise a knitted upper. The curved midsole 105 is not flexible, such that the curved midsole 105 retains the constant curvature depicted during push-off and collision.

Figure 1B:
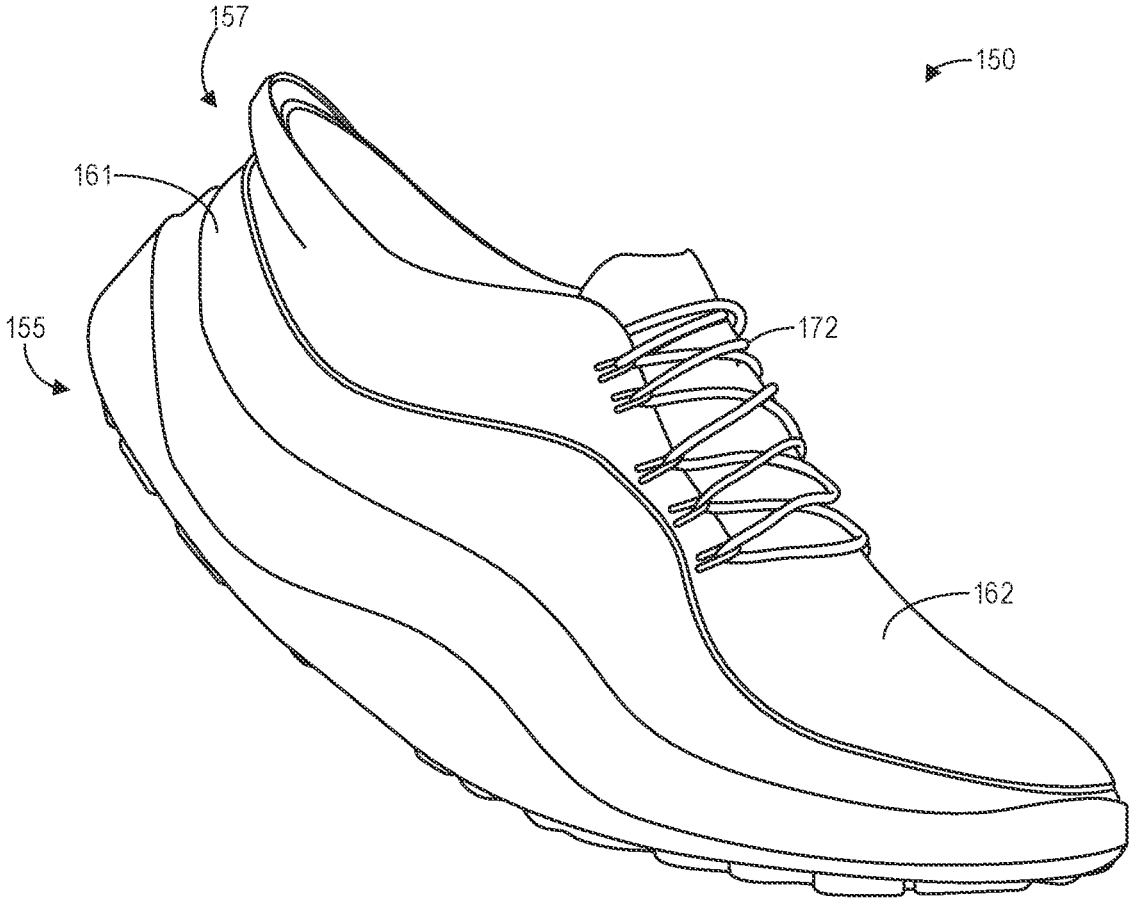
FIG. 1B shows a side lateral perspective view of a footwear article with a curved midsole.

FIG. 1B shows a side lateral perspective view of a footwear article 150 with a curved midsole 155 during a push-off at the toe of the footwear article 150. The upper 157 of the footwear article includes a first upper component 161 and a second upper component 162 of varying stretch to accommodate a foot inserted into the footwear article 150. As an example, the first upper component 161 may be less flexible than the second upper component 162, such that the reduced flexibility of the first upper component 161 helps to restrain the foot relative to the curved midsole 155 while the increased flexibility of the second upper component 162 enables the upper 157 to conform snugly to the foot. Further, a lace cord 172 may be laced through lace bights or loops extending from the second upper component 162 as depicted to allow a tightening of the upper 157 relative to the foot. Both the first upper component 161 and the second upper component 162 may comprise knitted components, for example.

Figure 2A:
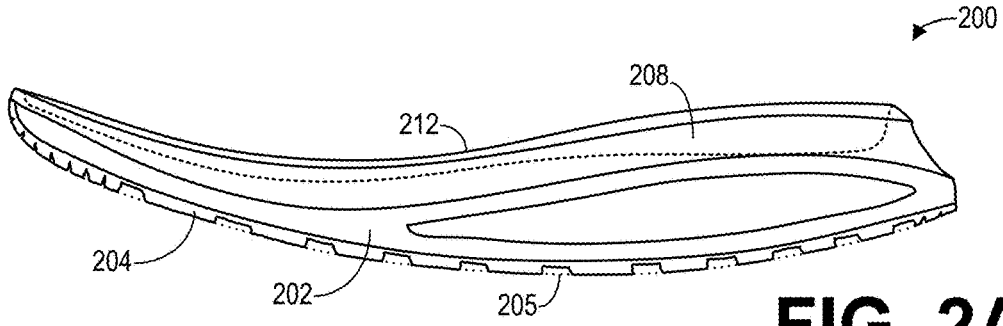
FIG. 2A shows a side medial view of an example curved midsole for a footwear article.

FIGS. 2A-2D show different example sole arrangements for a footwear article. In particular, FIG. 2A shows a side medial view of an example sole 200 comprising a curved midsole 202 as well as a curved outer sole 204. The dotted curve indicates a constant curvature 205 of the outer sole 204 despite the distribution of cutouts to provide traction, as depicted. The dashed line indicates a recessed area 208 of the midsole 202 whereupon a foot of a user wearing a footwear article configured with the sole 200 is positioned. The top 212 of the midsole 202 extends higher than the footbed or insole in the recessed area 208.

Figure 2B:
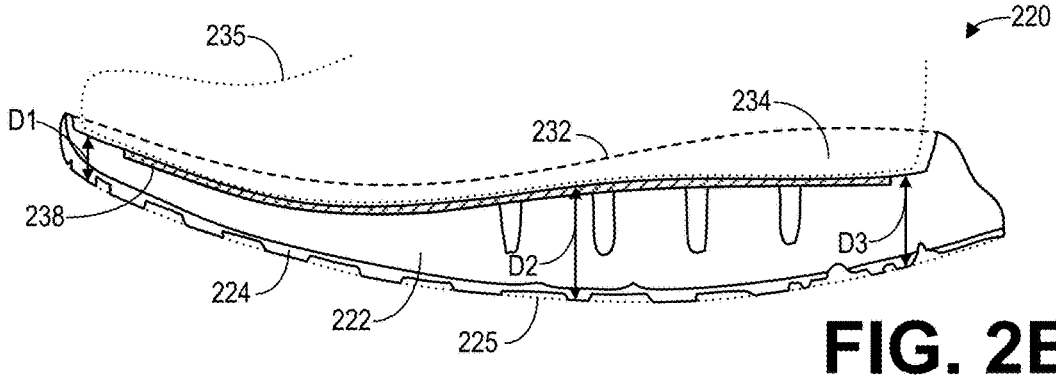
FIG. 2B shows a side medial view of another example curved midsole for a footwear article.

As another example, FIG. 2B shows a side medial cutaway view of another example sole 220 comprising a curved midsole 222 and a curved outer sole 224. The outer sole 224 includes a plurality of cutouts to provide traction, but still curves according to a constant curvature 225. The top 232 of the midsole 222 is depicted as a dashed line due to the cutaway view. Further, the relative position of a foot 235 to the sole 220 is shown. The foot 235 rests within the recessed area 234 of the midsole 222. Further, a moderation plate 238 is positioned in a recess adjacent to the recessed area 234 for the foot 235. As discussed further herein, the moderation plate 238 comprises an inflexible or stiff plate extending from the heel region of the foot 235 to the toe region of the foot 235. The moderation plate 238 is positioned in the center of the footwear article and extends past the known peak pressure zones of the heel and into lesser loaded areas. In this way, energy that would normally be lost or dissipated into the midsole and then into the ground is transferred to the stiff, rigid moderation plate 238. Further, by extending the plate along the length of the foot 235, the initial peak forces of a heel strike are transferred to the plate and carried through the lull of the gait (i.e., the phase between the heel strike and toe-off) and transferred through to the toe-off, which is further supported by the rigid platform of the moderation plate 238. Further, by positioning the moderation plate 238 in the recess of the midsole 222, the moderation plate 238 is positioned as close to the foot 235 as possible to maximize energy capture. Thus the moderation plate 238 provides an energy return such that each step while walking in a footwear article configured with the sole 220 is more powerful while involving less overall energy expenditure by the user in comparison to footwear articles without a moderation plate.

Figure 2C:
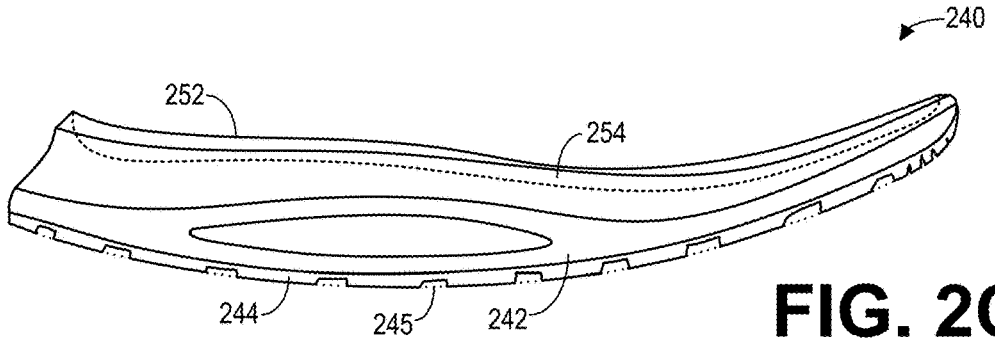
FIG. 2C shows a side lateral view of another example curved midsole for a footwear article.

As another example, FIG. 2C shows a side lateral view of another example sole 240 comprising a curved midsole 242 and a curved outer sole 244. The outer sole 244 includes a plurality of cutouts as depicted for traction, but still follows a constant curvature 245. Similar to the soles 200 and 220, a recessed area 254 in the midsole 242 (bound by the dashed line) is configured to receive a foot, while the top 252 of the midsole 242 extends around the recessed area 254 to form the recessed area 254.

Figure 2D:
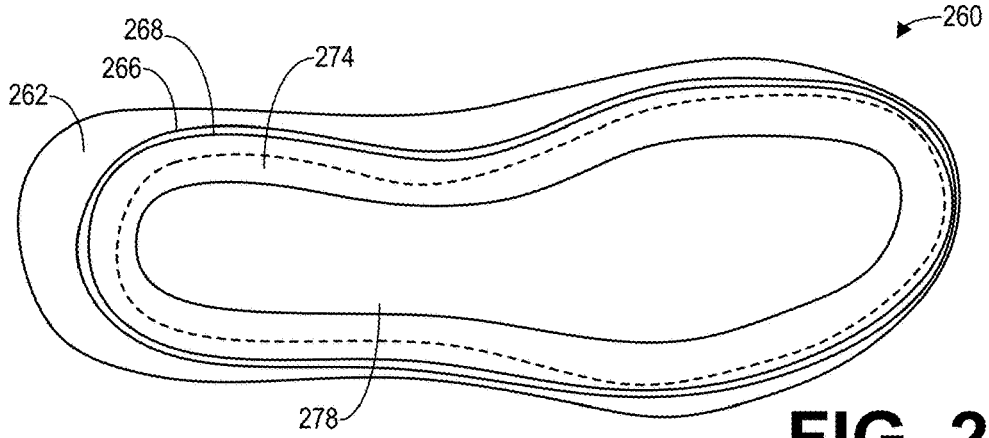
FIG. 2D shows a top view of an example curved midsole for a footwear article.

FIG. 2D shows a top view of an example sole 260 which may comprise a curved midsole 262 as well as a curved outer sole (not shown). The sole 260 may comprise the sole 200, the sole 220, or the sole 240 as described hereinabove. For example, the outer top rim 266 and the inner top rim 268 extend around a recessed area in the midsole 262, with a footbed or insole 274 at the bottom of the recessed area. Further, a moderation plate 278 is centered in the sole 260 and specifically is centered in the footbed 274. As discussed further herein with regard to FIGS. 4 and 5, the curved midsole 262 extends further away from the heel region of the foot. The width of the midfoot region of the midsole 262 is increased relative to the footbed 274, especially on the medial side, to decrease any possible instability caused by the increased height of the midfoot from the ground resulting from the constant curvature of the midsole 262.

FIG. 3 shows a diagram 300 illustrating constant curvature for a midsole 302 according to an embodiment. In particular, diagram 300 relates to determining a radius 342 of cylinder 340 defining curvature for a midsole 302. To determine the relation of the curvature to a last 305, which corresponds to the shape of a human foot, a plurality of cylinders are positioned under the last 305. In particular, the plurality of cylinders includes a first cylinder 310 with a first radius at a heel 320 of the last 305, a second cylinder 312 with a second radius 313 at a ball 322 of the last 305, and a third cylinder 314 with a third radius 315 at the toe tip 324 of the last 305. The radius of each cylinder 310, 312, and 314 may be selected according to a number of factors, including a heel to toe offset as well as a desired thickness of the midsole at the heel, ball, and tip, respectively. Further, although the cylinder 340 defining the curvature of the midsole 302 is depicted as touching each cylinder 310, 312, and 314 tangentially, it should be appreciated that in some examples the cylinder 340 may be tangentially fit to at least two of the cylinders 310, 312, and 314. For example, the radii 311, 313, and 315 of the cylinders 310, 312, and 314 may be independently selected according to desired thickness of the midsole at the heel, ball, and tip, respectively, as discussed above. However, in some instances it may not be possible to fit the cylinder 340 to all three of the cylinders 310, 312, and 314 as depicted. In such examples, the cylinder 340 may be fit to at least the first cylinder 310 and the second cylinder 312, such that the third radius 315 of the third cylinder 314 is a dependent variable of the radii 311, 313, and 342. In other examples, the cylinder 340 may be fit to the first cylinder 310 and the third cylinder 314, such that the second radius 313 of the second cylinder 312 is a dependent variable of the radii 311, 315, and 342.

As an illustrative example, the first radius 311 may be selected as 5 mm, the second radius 313 may be selected as 7.5 mm, and the third radius 315 may be selected as 12 mm. The radius 342 of the cylinder 340 fit to the first cylinder 310 and the third cylinder 314 is therefore 400 mm. Meanwhile, the radius 342 of the cylinder when fit to the first cylinder 310 and the second cylinder 312 is 450 mm.

It should be appreciated that the pivot position of the footwear article depends on the construction choice (e.g., the relative radii of the cylinders 310, 312, and 314) as well as the radius 342. In general, the pivot position of the footwear article (i.e., the position along the bottom surface of the midsole 302 in contact with a horizontal surface when the footwear article is placed at rest on the horizontal surface, or the point along the bottom surface of the midsole 302 around which the footwear article pivots during a stance phase of walking) may be positioned close to the ball 322.

It should be appreciated that such cylinders may be positioned virtually rather than physically under the last 305 for determining an appropriate radius 342 for a given size of the last 305 which may correspond to a size of a footwear article. As an illustrative example, the radius 342 for a footwear article of men's size 9 in US specification may vary from 380 mm to 500 mm. For example, in some embodiments, the radius 342 may comprise 400 mm for a footwear article of men's size 9 in US specification. The radius 342 may be scaled depending on the size of the footwear article, such that the radius 342 for a footwear article of men's size 12, for example, may range from 380 mm to 600 mm, whereas the radius 342 for a footwear article of women's size 7 may range from 300 cm to 500 cm.

In some examples, a 10 mm heel-toe offset may be provided by adjusting the relative radii of the cylinders 310, 312, and 314. Such an offset provides a lift that encourages forward momentum. It should be appreciated that the last 305 may be adapted to accommodate the heel-toe offset. The toe spring of the last 305 may also be increased relative to typical lasts in order to promote a powerful and complete toe-off and to fully capitalize on the constant curvature of the sole. Further, the last 305 may be adapted with a wide toe box which provides a more stable platform for generating power and thus allows for a more powerful toe-off.

Further, as mentioned hereinabove, the heel of the midsole 302 may be elongated or extend beyond the heel of the last 305. As an example, FIG. 4 shows a diagram 400 illustrating an example rear extension or heel extension for a curved midsole 302. In some examples, as depicted, the distance 418 of the heel extension of the midsole 302 may be measured from the vertical 412 at the heel of the last 305 normal or perpendicular to the cylinder 340 defining the curvature of the midsole 302, to the vertical 414 at the heel of the midsole 302 normal or perpendicular to the cylinder 340. The distance 418 may be selected to reduce the oscillating motion of the center of mass of the person wearing the footwear article, as the extended heel allows the foot of the leading leg (as opposed to the trailing leg) to collide with the ground sooner during a walking motion. Further, the distance 418 is selected such that the gait of a person walking is not affected. The distance 418 may range from 0 mm to 50 mm.

As another example, FIG. 5 shows a diagram 500 illustrating another example rear extension for a curved midsole 302. The distance 518 may be measured from the vertical 512 at the heel of the last 305 normal to a horizontal plane upon which the midsole 302 and last 305 are resting, to the vertical 514 at the heel of the midsole 302 normal to the horizontal plane. The distance 518 may be determined similar to the distance 418 as described above, and may also range from 0 mm to 50 mm.

In some examples, the curved midsole 302 may further include a forward extension, similar to the rear extension depicted in FIGS. 4 and 5, such that a forefoot or toe of the midsole 302 extends outward from a vertical (not shown) at the toe of the last 305. However, such a forward extension may interfere with the gait if the distance of the forward extension is substantial (e.g., greater than 2 cm).

FIG. 6 shows a footwear article 600 with a curved midsole and an example two-part upper 640 similar to the two-part upper 207 described hereinabove with regard to FIG. 2. The footwear article 600 further includes traction elements 622 and 624 selectively positioned on the curved midsole 610 to form an outer sole or outsole 620 of the footwear article 600 which utilize a center of pressure line as a guiding track for the positioning of the traction elements to optimize traction along the force transfer path. Further, traction elements are not positioned at a center of the footwear article 600, as depicted. As another illustrative example, FIG. 7 shows a footwear article 700 with a curved midsole 710, a curved outer sole or outsole 720, and another example two-part upper 740 similar to the two-part upper 207 described hereinabove.

In some examples, the footwear articles provided herein include a moderation plate for inhibiting the flexion of the metatarsal joint and to minimize the loss of energy during walking. As an example, FIG. 8 shows a diagram illustrating a side cross-sectional view of a footwear article 800 with a moderation plate 810 in a curved midsole 802. The midsole 802 incorporates a full length moderation plate 810 having several possible geometric profiles, as described further herein below with regard to FIGS. 11-16. The moderation plate 810 extends from the heel to the toe along the full length of the sole.

Upon initial contact with the ground, the energy produced by the wearer's weight, gravity, and motion is translated to the plate in the heel strike zone. The extended heel 830 provides a brief moment of cushioning before the full weight of the body is loaded onto the moderation plate 810. The moderation plate 810 is positioned in the center of the footwear article 800 and extends past the known peak pressure zones of the heel and into lesser loaded areas. In this way, more energy that would normally be dissipated into the footwear article 800 and then into the ground is instead transferred into the stiff, rigid moderation plate 810. By extending the moderation plate 810 from the heel to the toe of the wearer, the initial peak force(s) of the heel strike are captured and carried through the lull of the gait and then transferred to toe-off. Further, at the toe-off, the moderation plate 810 supports the motion by acting as a rigid platform for the toes. By providing a secure platform for the foot, with energy-returning materials such as the moderation plate 810, and furthermore by providing a smooth transition from heel strike to toe-off via the curved sole or curved midsole 802, the toe-off is smoother and more powerful while involving less overall energy expenditure by the user.

The moderation plate 810 may be made of any suitable material to achieve optimal and/or required range of stiffness. For example, the moderation plate 810 may be formed from carbon fiber for high-performance embodiments, or alternatively nylon, plastics, or a combination of nylon with another element such as glass for different embodiments.

The moderation plate 810 may be positioned as close as possible to the forefoot, i.e., between the midsole 302 and the sock line of the upper 805. As illustrative examples, FIG. 9 shows a diagram 900 illustrating a top view of a moderation plate 810 in a curved midsole 802, while FIG. 10 shows a diagram 1000 illustrating a perspective view of the moderation plate 810 in the curved midsole 802 relative to an inner wall 1012 of the curved midsole 802, an exterior surface 1010 of the curved midsole 802, and a top surface 1014 of the curved midsole 802. The moderation plate 810 may thus be positioned within a cavity of the midsole 802 which is formed with a same shape as the moderation plate 810 such that the moderation plate 810 is in face-sharing contact with the midsole 802 along the full length of the moderation plate 810 when positioned in the cavity.

Further, as depicted, the length of the moderation plate 810 along the longitudinal axis (i.e., from heel to toe) extends to most of the length of the midsole 802 along the longitudinal axis. The relative size of the moderation plate 810 to the midsole 802 may be as depicted in FIGS. 9 and 10. However, in some examples, the moderation plate 810 may extend further in the toe direction 912 towards and up to the forefront of the midsole 802, in the heel direction 911 towards and up to the heel of the midsole 802, in the lateral direction 913 towards and up to the lateral edge of the midsole 802, and/or in the medial direction 914 towards and up to the medial edge of the midsole 802. In other examples, the moderation plate 810 may be smaller than depicted in one or more of the directions 911, 912, 913, and 914.

The moderation plate 810 has at least two functions, including minimizing the loss of energy at the metatarsal joint by inhibiting the range of flexion of the metatarsal joint, and to work in combination with the midsole 802 to promote a smooth rolling of the foot while walking. The moderation plate 810 reduces the range of motion of the ankle joint, thereby further reducing energy lost during walking.

Figure 11:
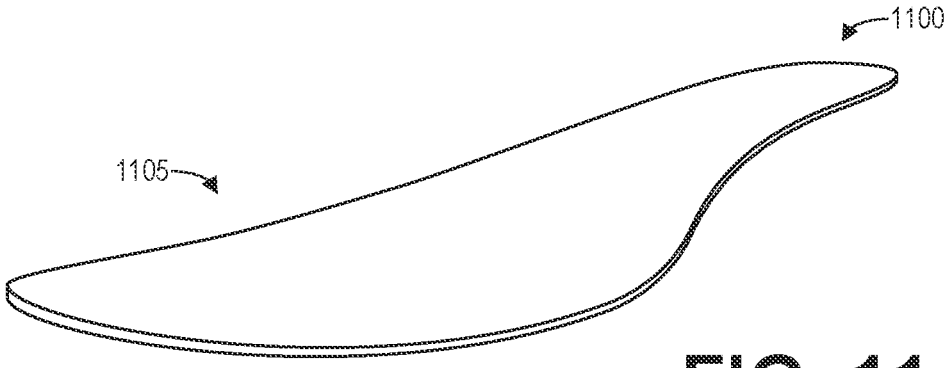
FIG. 11 shows a front medial perspective view of a first example moderation plate.
Figure 12:
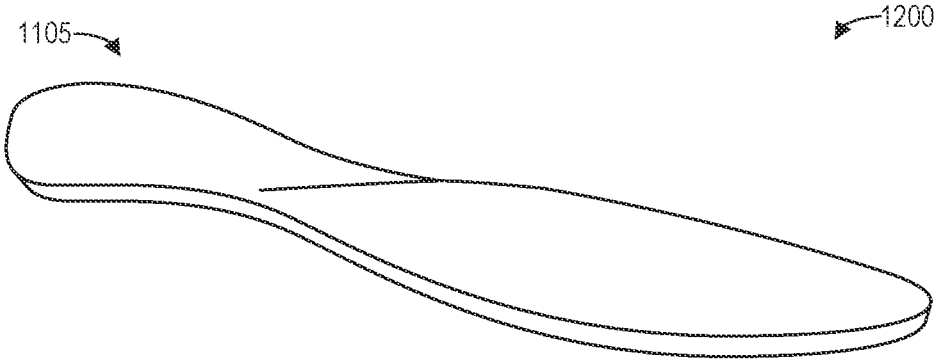
FIG. 12 shows a rear medial perspective view of the first example moderation plate.

As mentioned above, various geometric profiles of the moderation plate 810 may be selected to minimize energy expenditure during walking while also moderating or maintaining the curvature of the midsole 802. For example, the moderation plate may be shaped similar to the moderation plate 238 depicted in FIG. 2B. As another illustrative and non-limiting example, FIG. 11 shows a front medial perspective view 1100 of a first moderation plate 1105 while FIG. 12 shows a rear medial perspective view 1200 of the first moderation plate 1105. The first moderation plate 1105 is a relatively flat plate, with slight curvature to match the metatarsal joint when positioned in the midsole. In particular, as depicted, the first moderation plate 1105 curves slightly downward at the metatarsal joint towards the forefront of the moderation plate 1105, and then slightly up again closer to the toe. Further, the first moderation plate 1105 is relatively flat from the metatarsal joint towards the heel of the moderation plate 1105.

Figure 13:
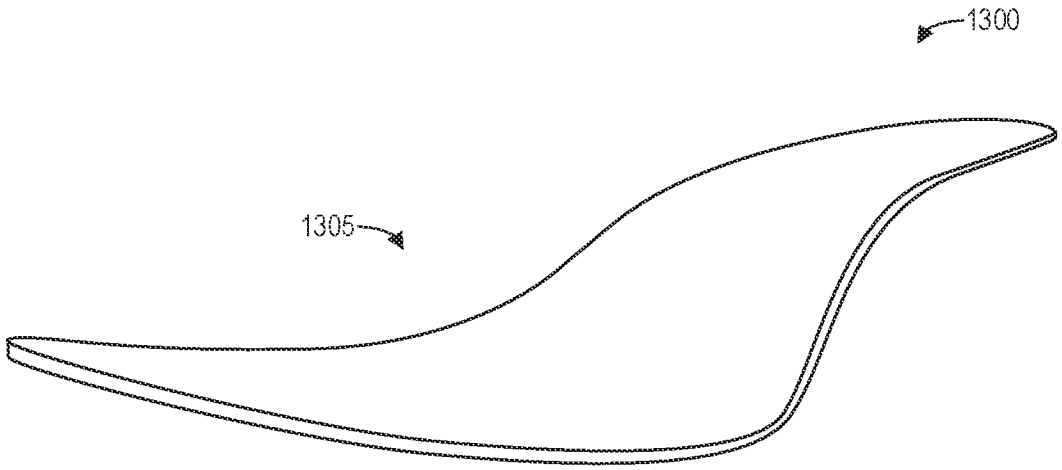
FIG. 13 shows a front medial perspective view of a second example moderation plate.
Figure 14:
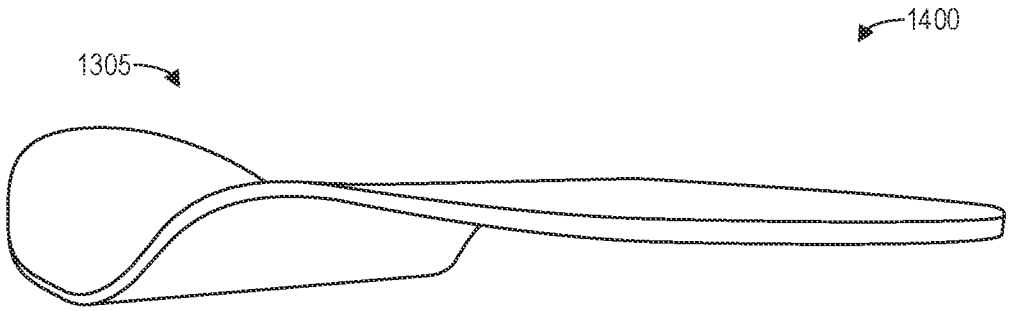
FIG. 14 shows a rear medial perspective view of the second example moderation plate.

As an additional illustrative and non-limiting example of a moderation plate, FIG. 13 shows a front medial perspective view 1300 of a second moderation plate 1305, while FIG. 14 shows a rear medial perspective view 1400 of the second moderation plate 1305. The second moderation plate 1305 exhibits an S-shape with a curvature at the metatarsal joint such that the moderation plate 1305 curves upwards and flattens towards the heel, while curving slightly upwards towards the toe, such that the segment of the moderation plate 1305 near the metatarsal joint is positioned downward relative to the toe and the heel of the moderation plate 1305.

Figure 15:
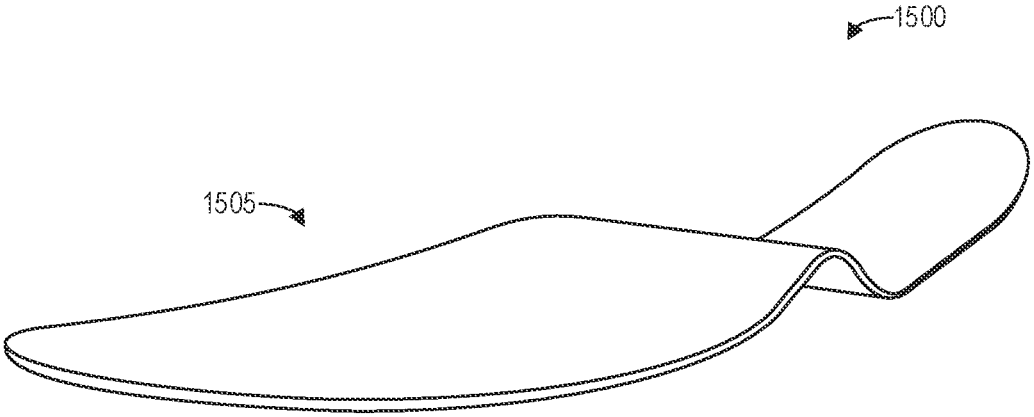
FIG. 15 shows a front medial perspective view of a third example moderation plate.
Figure 16:
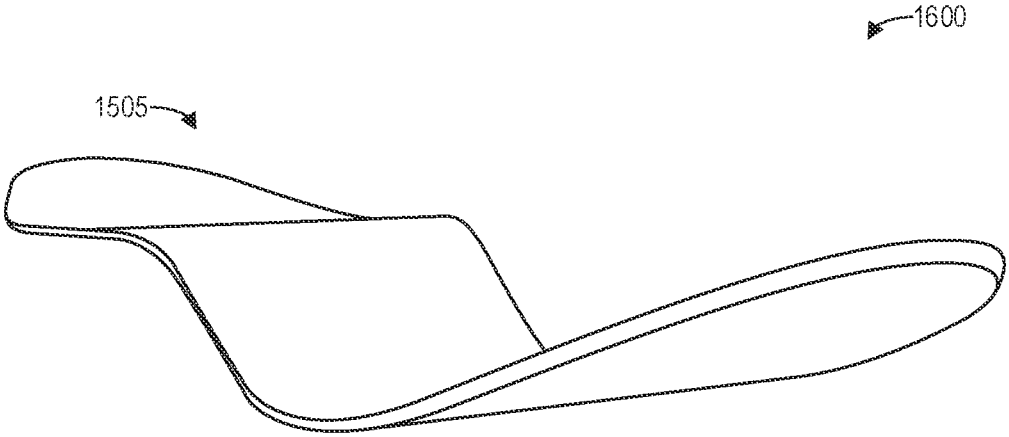
FIG. 16 shows a rear medial perspective view of the third example moderation plate.

As yet another illustrative and non-limiting example of a moderation plate, FIG. 15 shows a front medial perspective view 1500 of a third moderation plate 1505, while FIG. 16 shows a rear medial perspective view 1600 of the third moderation plate 1505. As depicted, the moderation plate 1505 exhibits an S-shape curvature with a flatter region along the forefoot and a slight upwards curvature towards the heel, with the curvature providing the S-shape positioned at the metatarsal joint.

It should be appreciated that the geometric profiles of the moderation plates disclosed herein are distinct from geometric profiles of moderation plates that may be used for footwear articles designed for running or jogging. As mentioned hereinabove, during running or jogging, a substantial amount of force impacts the heel during collision of the foot with the ground, and a moderation plate designed for a footwear article for running would likely be designed with a distinctly different curvature, and possible even an inverted curvature, with respect to the moderation plates described herein, to reduce the impact at the heel and/or to provide recoil energy back to the wearer during running.

Testing indicates that a moderation plate with a shape rather than a flat plate provides better performance, though moderation plate with too radical of a shape that acts like a spring may introduce biomechanical issues. Locating the plate close to the foot provides a stable platform on top of the cushioned sole, creating one complete unit. This allows the initial energy of the gait coming from bodyweight and gravity to transition directly to the plate which then captures the energy and also creates a stable platform on top of the cushioning provided by the midsole. Generally having a very stiff platform on top of a soft structure is not optimal for stability, and so the plate may be narrower than the overall width of the actual sole to promote stability. Further, the relative softness of the sole allows for deformation of the sole so the plate can move down into the sole and the sole up and around the plate. This allows for comfortable use of the footwear article on flat ground as well as uneven terrain including rocks, roots, or other inconsistent surfaces. If the plate extends too far to the sides, the plate creates a hard surface for the foot to shear off of and over the top of the sole.

Many current plated shoes that include a plate typically sandwich the plate between two layers of foam. This foam sandwiching creates a more cushioned feel which may be preferable in an on-road setting as it allows for a more substantial, immediate cushioning on initial impact followed by the transition of energy to the plate and then additional cushioning under the plate. However, this arrangement has drawbacks when applied to an off-road application. In an off-road setting, as the foot is loading the shoe at the same time a rock, root, or other foreign non-uniform object can load the shoe from the bottom, inside the shoe the plate which is sandwiched between two soft foams begins to shift under loads from different directions. With the plate being stiffer than the foams, the foams and the foot and body on the foam will be inclined to shear, thereby putting the body in a compromised position. Further, under extreme loads, such as a person walking or even jogging downhill (which increases the forces on impact) or if the person is carrying a load (e.g., a backpack), the plate is then at a less than ideal non-neutral angle which could promote instability to the point that a supination or rolling effect may occur with increased load and therefore speed, which may in turn may cause acute ankle or knee injuries such as ankle sprains. For these reasons, positioning the moderation plate closer to the foot, narrower and supported by a softer and wider foam is a safer option for off-road/trail use.

Further, positioning the moderation plate closer to the foot and away from the ground is especially advantageous when walking uphill with a substantial grade (e.g., greater than 5%). When walking uphill, for example, the apex of the moderation plate moves forward approximately 20 mm so the walker expends less effort before getting to this point. From that point on, the walker expends substantially less energy to maintain their position. Further, the moderation plate provides a stable platform extending from their heel to their toe, and the cushioning under the plate is confirming to the ground as opposed to the weight of the body. A moderation plate positioned closer to the ground, in contrast, hinders efficiency on hills, as the walker is forced to overcome the apex of the moderation plate earlier. Further, with the stiff moderation plate positioned closer to the ground, the shoe will tend to pivot from the point of contact down the hill so the walker has to do additional work to keep the shoe up and moving forward, while they sink into the soft midsole. Thus, for footwear articles intended for use on high-grade terrain, the moderation plate is preferably positioned as close to the foot as possible. For footwear articles intended for "urban" or flat use, wherein terrain is less graded and is more uniform, the plate may be positioned further away from the foot to increase cushioning and comfort. In some examples, the moderation plate may even be positioned in the midsole adjacent to the outer sole, and may be curved according to the constant curvature of the midsole and/or outer sole.

Further, in some embodiments, traction elements may be selectively positioned on an outsole of footwear articles provided herein according to a center-of-pressure line. As an example, FIG. 17 shows a diagram 1700 illustrating a center-of-pressure line 1717 along a foot 1715 relative to a midsole 1705 for selective placement of traction elements. The center-of-pressure line 1717 may be measured for the foot 1715 during walking without wearing a footwear article. In some examples, the curved midsole 1705 of the footwear articles described herein may shift the center-of-pressure line 1717. As such, the center-of-pressure may shift to a more medial center-of-pressure line 1720 or to a more lateral center-of-pressure line 1722, or may range between the center-of-pressure lines 1720 and 1722.

As mentioned above, traction elements may be selectively positioned along the average center-of-pressure line as typically exhibited during a stance phase while walking. Other traction elements are positioned in plantar areas where necessary and sufficient for traction, for example in the heel strike and toe-off areas. The placement of traction elements along the center-of-pressure line optimizes traction along the force transfer path and implements traction only where necessary, thereby increasing efficiency of walking and also reducing weight of the footwear article, thereby further reducing energy expenditure while walking.

The center-of-pressure line 1717 may further be utilized to minimize the amount of material in the midsole 1705. As an illustrative example, FIG. 18 shows a side lateral view of a footwear article 1800 with a curved midsole 1805 with minimized materials according to a center-of-pressure line. In particular, the midsole 1805 includes a cavity 1812 positioned along a midsection of the footwear article 1800 and away from the center-of-pressure line. In this way, the overall weight of the midsole 1805, and thus the footwear article 1800, is reduced, thereby minimizing energy expenditure while walking and in turn reducing fatigue during walking.

By constructing the upper 1810 from minimal weight materials, such as a 3D knitted upper with an incorporated minimal tongue and fusible material to achieve desired zonal stiffness by heat pressing, the weight of the footwear article 1810 is further reduced. Further, the midsole 1805 may be constructed from low density phylon, with blown rubber utilized for the outsole, and the moderation plate included in the midsole 1805 may be constructed from low density/stiffness ratio materials such as carbon fiber or reinforced nylon to further reduce the weight of the footwear article 1800.

In this way, the footwear article 1800 and other footwear articles described herein are constructed with a minimum yet sufficient number of components, with materials and construction techniques to achieve minimal possible weight, thus helping with minimization of energy expenditure while walking.

In some examples, the curvature of the midsole may extend through both the sagittal and the coronal plane. For example, rather than curving the midsole along the sagittal plane (i.e., from heel to toe) as described hereinabove with regard to FIG. 3, the curvature may extend along the center-of-pressure line. As an illustrative example, FIG. 19 shows a diagram 1900 illustrating a rotation of curvature of a curved midsole relative to the center-of-pressure line 1904 of a foot 1902. As depicted, a cylinder 1910 wherein central axis 1912 of the cylinder 1910 centered on the foot 1902 is aligned with a longitudinal axis of the foot 1902. The cylinder 1910 corresponds to the cylinder 340 described hereinabove with regard to FIG. 3, such that the curvature defined by the cylinder 1910 extends along the longitudinal axis of the foot 1902.

In some examples, the curvature may be instead defined by a cylinder such as cylinder 1920, which is rotated such that the central axis 1922 of the cylinder 1922 is rotated by an angle 1918 with respect to the central axis 1912 of the cylinder 1910, or similarly with respect to the longitudinal axis of the foot 1902. The angle 1918, as depicted, is selected such that the central axis 1922 is generally fit to the center-of-pressure line 1904 of the foot 1902. By defining the curvature of the midsole according to the cylinder 1910 rotated by the angle 1918, the rolling motion from heel strike to toe off during walking is further refined such that the trajectory of the center of motion of a person wearing the footwear article is smoother. It should be appreciated that in such examples, the geometric profile of the moderation plate contained with the midsole of the footwear article may be adjusted to accommodate the curvature of the midsole angled away from the longitudinal axis or the sagittal plane.

In some examples, the constant curvature of the midsole may be asymmetric. For example, to address pronation issues, the curvature may be offset such that the constant curvature on the lateral side of the midsole is greater than the constant curvature on the medial side of the midsole, or vice versa. For example, the medial side of the midsole may have a constant curvature of 410 or 420 mm, while the lateral side of the midsole may have a constant curvature of 400 mm.

Thus, in one embodiment, a footwear article comprises a midsole with a lower surface of constant curvature extending from a heel of the midsole to a toe of the midsole wherein the lower surface maintains the constant curvature throughout a stance phase of a walking gait.

In a first example of the footwear article, the footwear article further comprises a moderation plate positioned within a cavity of the midsole towards an upper surface of the midsole. In a second example of the footwear article optionally including the first example, the moderation plate includes curvature such that the curvature is positioned adjacent to a ball of a foot inserted into an upper of the footwear article. In a third example of the footwear article optionally including one or more of the first and second examples, the moderation plate is inflexible. In a fourth example of the footwear article optionally including one or more of the first through third examples, the heel of the midsole extends outward from a heel of a foot inserted into an upper of the footwear article. In a fifth example of the footwear article optionally including one or more of the first through fourth examples, the midsole is constructed of rigid material such that the constant curvature of the midsole does not deform during a stance phase of walking. In a sixth example of the footwear article optionally including one or more of the first through fifth examples, a plane of the constant curvature aligns with a center-of-pressure line of a foot inserted into an upper of the footwear article. In a seventh example of the footwear article optionally including one or more of the first through sixth examples, the footwear article further comprises a cavity in the midsole away from the center-of-pressure line. In an eighth example of the footwear article optionally including one or more of the first through seventh examples, the footwear article further comprises traction elements on an outsole coupled to the lower surface of the midsole, the traction elements selectively positioned along a center-of-pressure line of a foot inserted into an upper of the footwear article. In a ninth example of the footwear article optionally including one or more of the first through eighth examples, the footwear article further comprises an upper coupled to the midsole. In a tenth example of the footwear article optionally including one or more of the first through ninth examples, the upper comprise a first upper component and a second upper component, the first upper component coupled to the midsole and of a first flexibility, the second upper component coupled to the first upper component and of a second flexibility greater than the first flexibility. In an eleventh example of the footwear article optionally including one or more of the first through tenth examples, the second upper component defines a rim through which a foot is inserted into the footwear article. In a twelfth example of the footwear article optionally including one or more of the first through eleventh examples, the footwear article further comprises a lace cord, wherein the second upper component includes a plurality of lace bights through which the lace cord is laced. In a thirteenth example of the footwear article optionally including one or more of the first through twelfth examples, a radius of the constant curvature ranges from 300 mm to 550 mm.

In another embodiment, a footwear article comprises an upper, a midsole coupled to the upper, wherein a bottom surface of the midsole includes a constant curvature extending from a heel of the midsole to a toe of the midsole, a moderation plate positioned within the midsole at an upper surface of the midsole, and a sole coupled to the bottom surface of the midsole, the sole comprising a plurality of traction elements selectively positioned along a strike axis of the footwear article.

In a first example of the footwear article, a plane of the constant curvature extends along the strike axis. In a second example of the footwear article optionally including the first example, a heel of the midsole extends a specified length from a heel of the upper. In a third example of the footwear article, the moderation plate is inflexible, the midsole is rigid, and the upper comprises a knitted upper conformable to a foot positioned within the upper.

In yet another embodiment, a midsole for a footwear article comprises at least one rigid material forming a bottom surface with a constant curvature from a heel to a toe of the midsole, the constant curvature extending away from a relatively flat top surface.

In a first example of the midsole, a distance from the top surface to the bottom surface at the toe is a first distance D1 (shown in FIG. 2B), a distance from the top surface to the bottom surface at a central position of the midsole is a second distance D2, and a distance from the top surface to the bottom surface at the heel is a third distance D3, wherein the second distance is greater than the first distance and the third distance. In a second example of the midsole, the third distance is greater than the second distance.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A footwear article, comprising:

an upper;

a midsole coupled to the upper, wherein a bottom surface of the midsole includes a constant curvature extending from a heel of the midsole to a toe of the midsole, wherein the heel of the midsole is configured to be positioned under a back of a heel of a foot and the toe of the midsole is configured to be positioned under a toe tip of the foot when the foot is positioned within the upper, the midsole constructed of rigid material such that the constant curvature of the midsole does not deform during a stance phase of walking;

a moderation plate positioned within the midsole at an upper surface of the midsole; and an outsole coupled to the bottom surface of the midsole, the outsole comprising a plurality of traction elements selectively positioned along a strike axis of the footwear article.

2. The footwear article according to claim 1, wherein a plane of the constant curvature extends along the strike axis.

3. The footwear article according to claim 1, wherein the midsole includes a heel extension that extends a specified length from a heel of the upper, and wherein the heel of the midsole is coupled to the heel extension and is positioned below the heel of the upper.

4. The footwear article according to claim 1, wherein the moderation plate is inflexible, the midsole is rigid, and the upper comprises a knitted upper conformable to the foot when the foot is positioned within the upper.

5. A midsole for a footwear article, comprising:

at least one rigid material forming a bottom surface of the midsole, the bottom surface having a constant curvature from a heel of the midsole to a toe of the midsole, the constant curvature extending away from a relatively flat top surface of the midsole at the toe, wherein the heel of the midsole is configured to be positioned under a heel of a foot and the toe of the midsole is configured to be positioned under a toe of the foot when the foot is positioned on the midsole, and wherein the bottom surface of the midsole maintains the constant curvature throughout a stance phase of a walking gait.

6. The midsole of claim 5, wherein a distance from the top surface to the bottom surface at the toe is a first distance, a distance from the top surface to the bottom surface at a central position of the midsole is a second distance, and a distance from the top surface to the bottom surface at the heel is a third distance, wherein the second distance is greater than the first distance and the third distance.

7. The midsole of claim 6, wherein the third distance is greater than the first distance.

* * * * *